US007100884B2

(12) United States Patent
Lorber

(10) Patent No.: US 7,100,884 B2
(45) Date of Patent: Sep. 5, 2006

(54) DEVICE FOR HOLDING SHEETS

(76) Inventor: Kurt Lorber, Schurwaldstrasse 114, 73773 Aichwald (DE)

( * ) Notice: Subject to any disclaimer, the term of this patent is extended or adjusted under 35 U.S.C. 154(b) by 0 days.

(21) Appl. No.: 10/843,928

(22) Filed: May 12, 2004

(65) Prior Publication Data

US 2005/0253039 A1 Nov. 17, 2005

(51) Int. Cl.
*A47B 97/04* (2006.01)

(52) U.S. Cl. ..... 248/453; 248/206.5; 248/450; 24/67.11

(58) Field of Classification Search ..... 248/453, 248/450, 465.1, 444, 206.5; 24/67 R, 67.1, 24/67.11; 40/341, 600, 621
See application file for complete search history.

(56) References Cited

U.S. PATENT DOCUMENTS 490,569 A * 1/1893 Lehman ..... 248/453
1,611,231 A * 12/1926 Ratterman ..... 248/453
1,809,689 A * 6/1931 Graves ..... 24/549
1,841,690 A * 1/1932 Weindel, Jr. ..... 248/453
1,900,251 A * 3/1933 Moore ..... 248/463
4,480,356 A * 11/1984 Martin ..... 24/67.9
5,067,205 A * 11/1991 Chen et al. ..... 24/67.9
5,214,825 A * 6/1993 Hirzel ..... 24/67.9
5,511,661 A * 4/1996 Karlis et al. ..... 206/338
D479,558 S 9/2003 Lorber
6,729,591 B1 * 5/2004 Hsu ..... 248/205.6
6,776,385 B1 * 8/2004 Chang ..... 248/448

* cited by examiner

*Primary Examiner*—Amy J. Sterling
(74) *Attorney, Agent, or Firm*—Quarles & Brady LLP

(57) ABSTRACT

A device for holding individual sheets contains a circular baseplate with a weight. A U-shaped clip is integrally formed on the upper side of the baseplate and is situated in a plane running obliquely with respect to the upper side of the baseplate. Arranged within the clip is an inner element which forms a gap between its outside and the inside of the clip. Paper can be inserted into this gap.

12 Claims, 1 Drawing Sheet

DEVICE FOR HOLDING SHEETS

The invention relates to a device for holding individual sheets or a plurality of sheets.

Individual sheets have frequently to be secured on a writing table in such a manner that they can be comfortably read. Attachment to pin boards or the like always presupposes that there is a vertical surface. This manner of temporarily securing individual sheets in order to read them is therefore not suitable if it is to be used for writing tables or desks.

The invention is based on the object of providing a device for holding individual sheets, which device is constructed as simply as possible and is easy to handle.

To achieve this object, the invention proposes a device for holding sheets, the device having a baseplate to which a clip having two legs is attached. Arranged in the opening of the clip is an inner part which is situated in the plane of the clip and is at a distance, forming a gap, from the inside of the clip. The inner part is likewise attached to the baseplate. The sheets of paper or else other flat objects can be inserted between the clip and the inner part, so that they are held by both of them. Since the inner part and the clip are situated in the same plane, the sheet of paper is slightly deformed as a result, which increases its stability. This also enables relatively large sheets to be attached in this securing device without them folding over. The baseplate can simply be placed onto a table or on another base running at least approximately horizontally. The base may also be slightly inclined.

In another development of the invention, provision may be made for the clip to be attached to the baseplate at an acute angle. This enables the sheet to be slightly inclined with respect to the table surface.

In order to make it easier to introduce a sheet between the clip and the inner part, provision may be made according to the invention for the end of the inner part to be bent away out of the plane of the clip.

Provision may be made for the clip and the inner part to be designed as flat profiles, the flat side of the profiles being situated in the plane of the clip.

In order to increase the stability, provision may be made for the clip to be connected to the base along a web connecting its two legs. This enlarges the region of connection between the clip and the baseplate.

The inner part may be integrally formed with one leg on this web.

The web connecting the two legs of the clip may be interrupted, in particular in the centre, so that in practice two webs are formed which meet approximately in the centre of the baseplate where they leave a small space. The inner part may then accordingly have two parallel legs which are integrally formed on the ends of these two webs of the clip and which run parallel to the legs of the clip.

The inner part may have a clip integrally formed at the end of one or both legs, said clip corresponding approximately to the shape of the outer clip. This results in the formation of a gap of virtually constant width over the entire length between the inner part and the outer clip.

A weight, for example in the form of a metal piece, the external shape of which corresponds approximately to the external shape of the baseplate, may be inserted into the baseplate, in particular from the lower side thereof.

Provision may likewise be made for the lower side of the baseplate to have a downwardly open groove along its edge. A simple O-ring, which consists of elastomeric material and the diameter of which is somewhat larger than the width or also the depth of the groove, may be inserted into this groove. As a result, the O-ring is secured under tension. If it protrudes over the lower side of the baseplate, it may serve in this manner as a foot for the baseplate. The latter is thereby prevented from sliding away. In addition, a direct contact between the preferably metallic weight and the writing-table top is prevented, so that tracks are not produced when the device is displaced.

The invention makes provision for the entire device, with the exception of course of the weight and the O-ring, to be injection molded from plastic as a single piece.

The legs of the clip and the legs of the inner part preferably run parallel to one another.

Further features, details and advantages of the invention emerge from the following description of a preferred embodiment of the invention and with reference to the drawing, in which.

Figure 1:
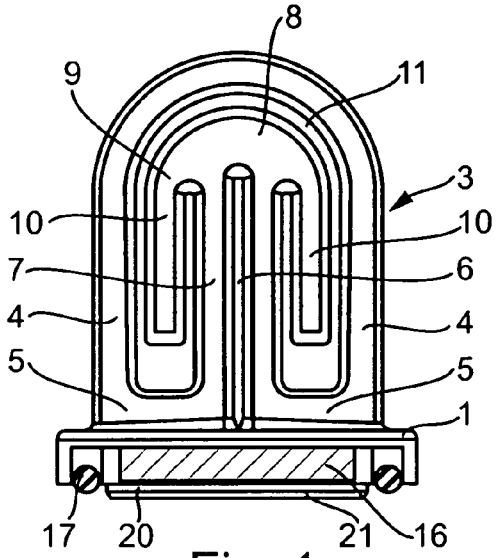
FIG. 1 shows the end view of a device according to the invention with a sectioned foot part.
Figure 2:
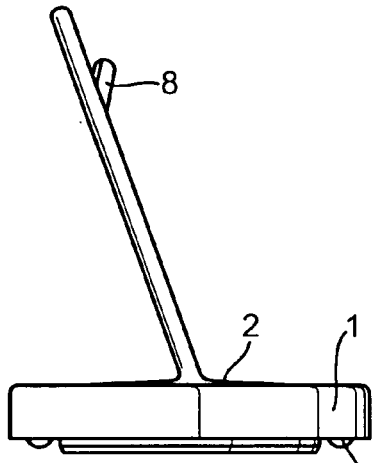
FIG. 2 shows the view of the arrangement from the left in FIG. 1.
Figure 3:
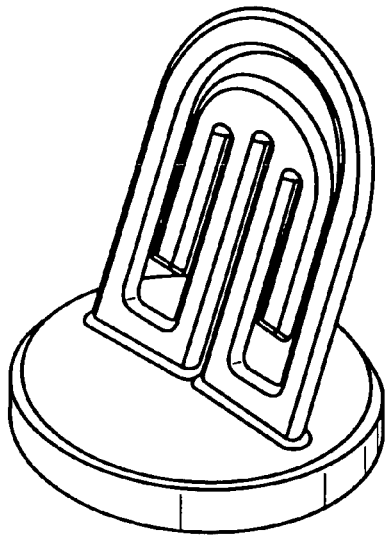
FIG. 3 shows a perspective view obliquely from above of the device proposed by the invention.
Figure 4:
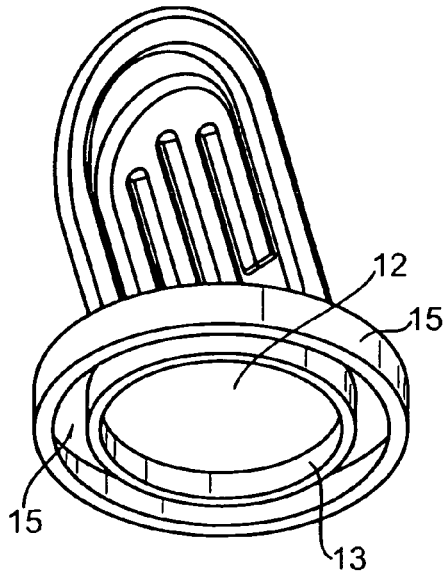
FIG. 4 shows a perspective view obliquely from below of the device proposed by the invention.

The device proposed by the invention contains a baseplate 1 which is of circular design. An outer clip 3 which runs at an angle of approximately 70° with respect to the upper side 2 of the baseplate 1 is attached to the planar upper side 2 of the baseplate 1. The clip 3 has two parallel, flat legs 4 which, as seen from the front, run perpendicular with respect to the baseplate 1. At their ends facing the baseplate 1, the legs 4 in each case have a web 5 which is likewise connected to the baseplate 1. A slot 6 is formed between the inner ends of the two webs 5. Two legs 7 are integrally formed as a single piece on the inner ends of the webs 5 and, in the region of their end which faces away from the baseplate 1, are connected to a tongue 8. The tongue 8 is a part of a likewise U-shaped clip 9 which then has two parallel wings 10 which, for their part, again run parallel to the legs 4 of the outer clip 3. The shape of this inner clip 9 corresponds to the shape of the outer clip 3. A gap 11 is formed between the inner clip 9 and the outer clip 3. The inner clip and the outer clip are situated in one plane. This is revealed in FIG. 2. FIG. 2 shows the side view of the arrangement of FIG. 1. The tongue 8 is bent inward slightly form the plane of the outer clip, so that a sheet of paper can be inserted from above in FIG. 2 between the inner clip and the outer clip. The sheet of paper can then be inserted through the gap as far as the lower webs 5.

Two recesses are formed on the lower side of the baseplate 1, namely a central recess 12 which is bounded by a skirt 13, and as a result, a downwardly open groove 15 is formed between the skirt 13 and the outer edge 14. A metal piece 16 which serves as a weight is inserted into the inner recess 12. The metal piece may, for example, be bonded in place, but it may also have been encapsulated by injection molding during the production of the device from plastic. The lower surface of the weight 16 does not reach quite as far as the lower surface of the baseplate 1. An O-ring 17 (indicated) is pressed into the groove 15 running around the recess 12 with the weight 16 and is secured by tension. As can be gathered from FIG. 2, this O-ring 17 protrudes downward somewhat over the lower surface of the baseplate 1. As a result, the device may be displaced over a table surface, contact then taking place along the O-ring 17.

It is possible and is proposed by the invention to use the device with a metallic plate 20 which can be bonded on a surface with the aid of a bonding layer 21. The plate 20 is preferably defined as a magnet. Although the weight 16 is of ferromagnetic material, it is not itself magnetizing. This means that the device may also be used in the vicinity of viewing screens. However, the magnetic plate makes it possible then to use the device even on surfaces which do not run horizontally.

The invention claimed is:

1. A device for securing sheets, having a baseplate to which a clip having an opening and having two legs and a web defining only a single plane is attached, said device having an inner element which is arranged in the opening of the clip, the inner element being situated in the plane of the two legs, and being at a distance, forming a gap, from the inside of the two legs, the inner element being attached to the baseplate;

wherein the plane defined by the two legs of the clip is arranged at an angle between forty-five degrees and ninety degrees from said baseplate;

wherein a weight is inserted into the baseplate; and wherein a magnet is arranged on a the lower portion of the base plate.

2. The device of claim 1, wherein the plane of the two legs of the clip is arranged at an angle of approximately 70° with respect to the baseplate.

3. The device as claimed in claim 1, wherein the inner element has a tongue that is bent away out of the plane defined by the two legs of the clip.

4. The device as claimed in claim 1, wherein the clip and the inner element have a flat profile.

5. The device as claimed in claim 1, wherein the clip is connected to the baseplate along the web, which connects the two legs to the baseplate.

6. The device as claimed in claim 5, wherein the inner element has a leg arranged on the web of the clip.

7. The device as claimed in claim 5, wherein the web connecting the two legs of the clip is interrupted approximately in the center of its length and has ends defined by the interrupted web.

8. The device as claimed in claim 7, wherein the inner element has two parallel legs which are attached to the ends of the interrupted web connecting the two legs of the clip.

9. The device as claimed in claim 1, wherein the inner element is in a shape that corresponds to a shape of a portion of the clip that includes the two legs.

10. A device for securing sheets, having a baseplate to which a clip having two legs defining a plane is attached, said clip having an opening between said two legs, said device having an inner element which is arranged in the opening of the clip, the inner element being situated in the plane of the two legs of the clip, and being at a distance, forming a gap, from the inside of the two legs of the clip, the inner element being attached to the baseplate;

wherein a downwardly opening groove is arranged on the lower portion of the base plate; and wherein an O-ring, the diameter of which is larger than the depth of the groove, is inserted under tension into the groove.

11. The device as claimed in claim 1, wherein the entire device is injection molded from plastic as a single piece.

12. The device as claimed in claim 1, wherein the legs of the clip run parallel to each other.

* * * * *